US009048606B2

(12) United States Patent
Shinmi

(10) Patent No.: US 9,048,606 B2
(45) Date of Patent: Jun. 2, 2015

(54) PRESS BOND TERMINAL AND METHOD FOR PRESSING AND BONDING TERMINAL

(75) Inventor: Yoshifumi Shinmi, Makinohara (KP)

(73) Assignee: YAZAKI CORPORATION, Tokyo (JP)

( * ) Notice: Subject to any disclaimer, the term of this patent is extended or adjusted under 35 U.S.C. 154(b) by 31 days.

(21) Appl. No.: 13/508,637

(22) PCT Filed: Oct. 25, 2010

(86) PCT No.: PCT/JP2010/068880
§ 371 (c)(1),
(2), (4) Date: May 8, 2012

(87) PCT Pub. No.: WO2011/058872
PCT Pub. Date: May 19, 2011

(65) Prior Publication Data

US 2012/0231678 A1 Sep. 13, 2012

(30) Foreign Application Priority Data

Nov. 12, 2009 (JP) ..... 2009-258534

(51) Int. Cl.
*H01R 4/10* (2006.01)
*H01R 43/048* (2006.01)
*H01R 4/18* (2006.01)

(52) U.S. Cl.
CPC ..... *H01R 43/048* (2013.01); *H01R 4/188* (2013.01); *H01R 4/184* (2013.01)

(58) Field of Classification Search
USPC ..... 439/394, 441–442, 866–867, 578, 439/395–407, 877–881, 502; 174/84 R
See application file for complete search history.

(56) References Cited

U.S. PATENT DOCUMENTS 3,032,602 A * 5/1962 Farnell ..... 174/90
3,404,368 A * 10/1968 Roberts et al. ..... 439/866

(Continued)

FOREIGN PATENT DOCUMENTS

CN 1591979 A 3/2005
CN 1667876 A 9/2005

(Continued)

OTHER PUBLICATIONS

International Search Report for PCT/JP2010/068880 dated Nov. 22, 2010 [PCT/ISA/210].

(Continued)

*Primary Examiner* — Jean F Duverne
(74) *Attorney, Agent, or Firm* — Sughrue Mion, PLLC

(57) ABSTRACT

An object of the invention is to improve electrical connection performance by increasing a pressure of contact between an electric wire and a terminal. A conductor press bond part (11) of a terminal is formed in substantially a U-shaped cross section opened upward by a base plate (11A) and a pair of conductor crimp pieces (11B, 11B) extended upward from both right and left lateral edges of the base plate (11A). A range from the base plate (11A) to the root of the pair of conductor crimp pieces (11B, 11B) is formed as a curved wall (11H) with substantially a circular arc shape, and when a radius of curvature of an inner surface of the curved wall (11H) is R and a radius of a conductor of the electric wire is r, the curved wall is set so as to satisfy R<r. In the case of pressing and bonding this terminal to the electric wire, the conductor (Wa) of the electric wire is inserted between the pair of conductor crimp pieces (11B, 11B) and by a press bond operation of a lower mold (101) and an upper mold (102) of a press bond device in its insertion state, the pair of conductor crimp pieces (11B, 11B) is inward rounded to be crimped so as to wrap the conductor (Wa) with the base plate (11A).

2 Claims, 4 Drawing Sheets

(56) References Cited

U.S. PATENT DOCUMENTS

| | | | | |
|---|---|---|---|---|
| 4,142,771 | A * | 3/1979 | Barnes et al. | 439/442 |
| 5,445,535 | A * | 8/1995 | Phillips et al. | 439/394 |
| 2001/0016460 | A1 | 8/2001 | Koide | |
| 2002/0038511 | A1 | 4/2002 | Kuwayama et al. | |
| 2005/0026515 | A1 | 2/2005 | Hashimoto et al. | |
| 2005/0050725 | A1 | 3/2005 | Kuwayama et al. | |
| 2008/0172864 | A1 | 7/2008 | Yagi et al. | |
| 2010/0192366 | A1 | 8/2010 | Ito | |

FOREIGN PATENT DOCUMENTS

| | | | |
|---|---|---|---|
| CN | 101227056 | A | 7/2008 |
| JP | 5-109458 | A | 4/1993 |
| JP | 2001-217013 | A | 8/2001 |
| JP | 2002-100452 | A | 4/2002 |
| JP | 2006-228759 | A | 8/2006 |
| JP | 2008-177033 | A | 7/2008 |
| JP | 2009-037909 | A | 2/2009 |

OTHER PUBLICATIONS

Written Opinion for PCT/JP2010/068880 dated Nov. 22, 2010 [PCT/ISA/237].

Communication from the Japanese Patent Office dated Aug. 26, 2013, in a counterpart Japanese application No. 2009-258534.

Office Action dated Jan. 30, 2014 issued by the State Intellectual Property Office of the People's Republic of China in counterpart Chinese Patent Application No. 201080049215.2.

Communication issued on Jan. 19, 2015 by The State Intellectual Property Office of the PR of China in related application No. 201080049215.2.

Extended European Search Report dated Oct. 30, 2014 issued by European Patent Office in counterpart European Application No. 10829832.4.

Office Action issued Aug. 13, 2014, by the State Intellectual Property Office of PR China in related Application No. 201080049215.2.

* cited by examiner

PRESS BOND TERMINAL AND METHOD FOR PRESSING AND BONDING TERMINAL

TECHNICAL FIELD

The present invention relates to a press bond terminal of an open barrel type having a conductor press bond part with a U-shaped cross section used in, for example, an electrical equipment system of an automobile, and a method for pressing and bonding a terminal using the press bond terminal.

BACKGROUND ART

FIG. 4 is a perspective view showing a configuration of a conventional press bond terminal described in, for example, Patent Reference 1.

This press bond terminal 1 includes an electrical connection part 10 connected to a terminal of the other connector side (not shown) in the front of a longitudinal direction (also a longitudinal direction of a conductor of an electric wire connected) of the terminal, and includes a conductor press bond part 11 crimped to the conductor in which the distal end of the electric wire (not shown) is exposed in the back of the electrical connection part 10, and further includes a coating crimp part 12 crimped to the portion having an insulating coating in the electric wire in the back of the conductor press bond part 11. Also, a first joining part 13 for joining the electrical connection part 10 to the conductor press bond part 11 is included between the electrical connection part 10 and the conductor press bond part 11, and a second joining part 14 for joining the conductor press bond part 11 to the coating crimp part 12 is included between the conductor press bond part 11 and the coating crimp part 12.

The conductor press bond part 11 is formed in substantially a U-shaped cross section opened upward by a base plate 11A and a pair of conductor crimp pieces 11B, 11B which is extended upward from both right and left lateral edges of the base plate 11A and is crimped so as to wrap the conductor of the electric wire disposed on an inner surface of the base plate 11A. Also, the coating crimp part 12 is formed in substantially a U-shaped cross section by a base plate 12A and a pair of coating crimp pieces 12B, 12B which is extended upward from both right and left lateral edges of the base plate 12A and is crimped so as to wrap the electric wire (that is, the portion having the insulating coating) disposed on an inner surface of the base plate 12A.

Also, an inner surface of the conductor press bond part 11 is provided with plural serrations 18 with a recessed groove shape extending in a direction orthogonal to the longitudinal direction (that is, the longitudinal direction of the terminal) of the conductor of the electric wire.

In the case of pressing and bonding the conductor press bond part 11 of this press bond terminal 1 to the conductor of the distal end of the electric wire, the press bond terminal is placed on a placement surface (that is, an upper surface) of a lower mold (that is, an anvil) (not shown) and also, the conductor of the distal end of the electric wire is inserted between the conductor crimp pieces of the conductor press bond part and a conductor Wa is placed on an upper surface of the base plate 11A as shown in FIG. 5. Normally, the range from the base plate 11A to the root of a pair of conductor crimp pieces 11B, 11B is formed as a curved wall 11H with a radius R of curvature larger than a radius r of the conductor Wa, with the result that the conductor Wa guided between the conductor crimp pieces 11B, 11B is placed in a state of making contact with an inner surface of the base plate 11A of the conductor press bond part 11.

By downward moving an upper mold (that is, a crimper) relatively with respect to the lower mold in this state, the distal end sides of the conductor crimp pieces are gradually laid inward by a guide inclined surface of the upper mold and by further downward moving the upper mold (that is, the crimper) relatively with respect to the lower mold, finally, the distal ends of the conductor crimp pieces 11B are rounded so as to be folded back to the side of the conductor Wa by a curved surface ranging from the guide inclined surface of the upper mold to a chevron-shaped part of the center, and the distal ends of the conductor crimp pieces 11B are mutually bitten into the conductor Wa while being rubbed together and thereby, the conductor crimp pieces 11B are crimped so as to wrap the conductor Wa.

By the above operation, the conductor press bond part 11 of the press bond terminal 1 can be connected to the conductor Wa of the electric wire by press bonding. In addition, similarly in the coating crimp part 12, using the lower mold and the upper mold, the coating crimp pieces 12B are gradually bent inward and are crimped to the portion having the insulating coating in the electric wire. This allows the press bond terminal 1 to be electrically and mechanically connected to the electric wire.

PRIOR ART REFERENCE

Patent Reference

Patent Reference 1: JP-A-2006-228759 (FIG. 1)

DISCLOSURE OF THE INVENTION

Problems that the Invention is to Solve

Incidentally, in the case of the conventional press bond terminal described above, the radius R of curvature of the curved wall 11H constructing the range from the base plate 11A of the conductor press bond part 11 to the root of a pair of conductor crimp pieces 11B, 11B is set so as to become larger than the radius r of the conductor Wa of the electric wire wrapped inward, so that a pressure of contact between the terminal and the conductor at the time of obtaining a press bond state finally does not become very high and there is a problem that contact resistance tends to become unstable.

In view of the circumstances described above, an object of the invention is to provide a press bond terminal capable of improving electrical connection performance by increasing a pressure of contact between an electric wire and the terminal, and a method for pressing and bonding the terminal using the press bond terminal.

Means for Solving the Problems (1) In order to solve the problem described above, a first aspect of the invention provides a press bond terminal having a conductor press bond part connected by being pressed and bonded to a distal end of a conductor of an electric wire, the conductor press bond part being formed in substantially a U-shaped cross section opened upward by a base plate and a pair of conductor crimp pieces extended upward from both right and left lateral edges of the base plate, the press bond terminal being electrically connected to the electric wire by inserting the conductor of the electric wire between the pair of conductor crimp pieces in the case of being pressed and bonded to the electric wire and inward rounding the pair of conductor crimp pieces to crimp the conductor crimp pieces so as to wrap the conductor with the base plate by a press bond operation of a lower mold and an upper mold of a press bond device in its insertion state, wherein a range from the base plate to the root of the pair of conductor crimp pieces is formed as a curved wall with substantially a circular arc shape and when a radius of curvature of an inner surface of the curved wall is R and a radius of the conductor of the electric wire is r, the curved wall is set so as to satisfy R<r.

(2) In order to solve the problem described above, a second aspect of the invention provides a method for pressing and bonding a terminal, wherein a press bond terminal of (1) described above is arranged between an upper mold and a lower mold of a press bond device and also a distal end of a conductor of the electric wire is inserted between the pair of conductor crimp pieces and the upper mold is downward moved relatively with respect to the lower mold in its insertion state and thereby the pair of conductor crimp pieces is laid inward by action of a guide inclined surface of the upper mold and further the upper mold is downward moved relatively with respect to the lower mold and thereby the pair of conductor crimp pieces is rounded inward so as to be folded back to the conductor side by action of a curved surface ranging from the guide inclined surface of the upper mold to a chevron-shaped part of the center and finally distal ends of the conductor crimp pieces are mutually bitten into the conductor while being rubbed together and thereby both conductor crimp pieces are crimped so as to wrap the conductor with the base plate.

Advantage of the Invention

According to the press bond terminal of (1) described above, the radius R of curvature of the inner surface of the curved wall (that is, the range from the base plate of the conductor press bond part to the root of a pair of conductor crimp pieces) is set smaller than the radius r of the conductor of the electric wire, so that when the conductor of the electric wire is inserted between the conductor crimp pieces before press bonding, the conductor abuts on inner surfaces of the conductor crimp pieces in the middle of a height direction of the conductor crimp pieces and stops, and is held in a state of no contact with the base plate of the conductor press bond part. When press bond processing is performed by downward moving the upper mold of the press bond device relatively with respect to the lower mold from this state, the distal ends of a pair of conductor crimp pieces are gradually laid inward by making contact with a guide inclined surface of the upper mold and by further downward moving the upper mold relatively with respect to the lower mold, the distal ends of a pair of conductor crimp pieces abut on a curved surface ranging from the guide inclined surface of the upper mold to a chevron-shaped part of the center and thereby are guided inward and are rounded so as to be folded back to the side of the conductor and, finally, the distal ends of both conductor crimp pieces are mutually bitten into the conductor while being rubbed together and thereby, both conductor crimp pieces are crimped so as to wrap the conductor with the base plate.

In the case of that series of operations, the conductor of the electric wire is pushed on the base plate of the conductor press bond part and accordingly, the curved wall (the range from the base plate to the root of the conductor crimp pieces) is outward pushed out by being subjected to a pressure from the conductor and a pressure from the conductor crimp pieces. Then, in a state of outward pushing out the curved wall, the distal ends of the conductor crimp pieces are finally crimped so as to be bitten into the conductor to complete the press bonding.

Therefore, in a final press bond state, a great spring-back force by which the curved wall returns to the original shape with small curvature is generated in the curved wall. Particularly, the spring-back forces generated at the boundaries (the portions called "shoulder parts") between the base plate and the root of the conductor crimp pieces act as a contact pressure of making close contact with the conductor wrapped inward, with the result that adhesion between the conductor and the terminal increases and contact resistance is low to become stable, and electrical connection performance can be improved.

According to the method for pressing and bonding the terminal of (2) described above, the press bond terminal of (1) described above is pressed and bonded to the conductor of the electric wire using the upper mold and the lower mold, so that the spring-back force can effectively be generated with respect to the terminal, and the terminal can be connected to the electric wire by stable contact resistance.

MODE FOR CARRYING OUT THE INVENTION

An embodiment of the invention will hereinafter be described using the drawings.

Figure 1A:
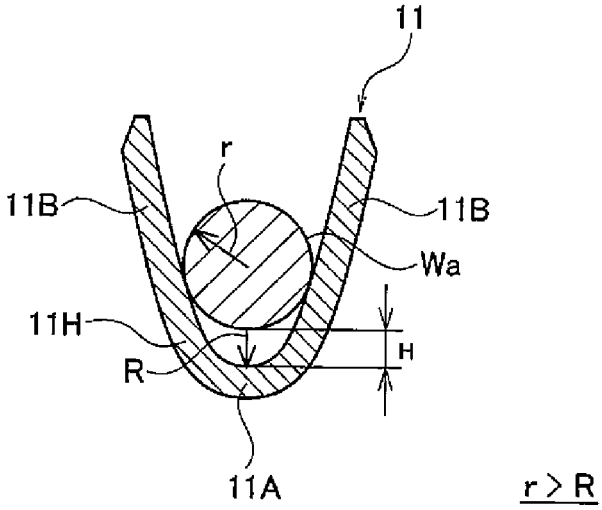
FIGS. 1(*a*) and 1(*b*) are main configuration diagrams of a press bond terminal of an embodiment of the invention, and FIG. 1(*a*) is a sectional view showing a relation between a conductor press bond part of the press bond terminal and a conductor of an electric wire, and FIG. 1(*b*) is a diagram showing an initial stage of an operation in the case of pressing and bonding the conductor press bond part to the conductor.
Figure 1B:
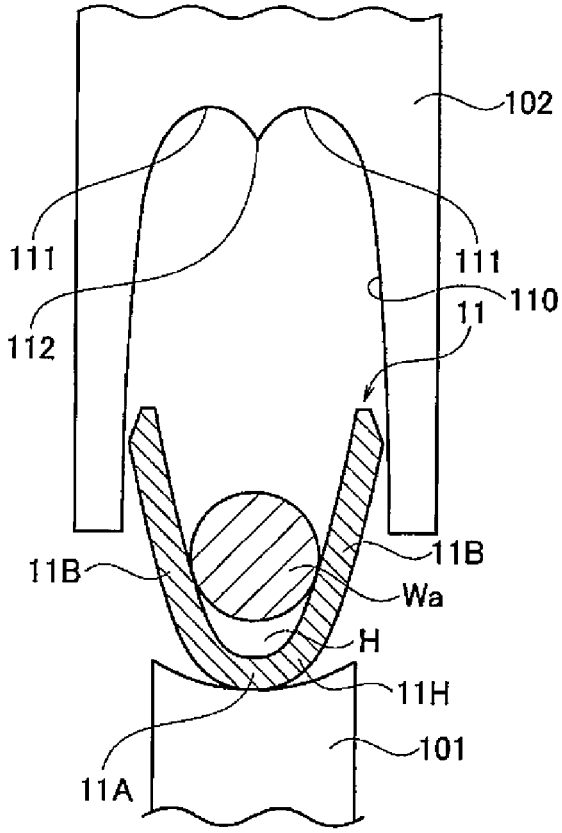
Figure 2A:
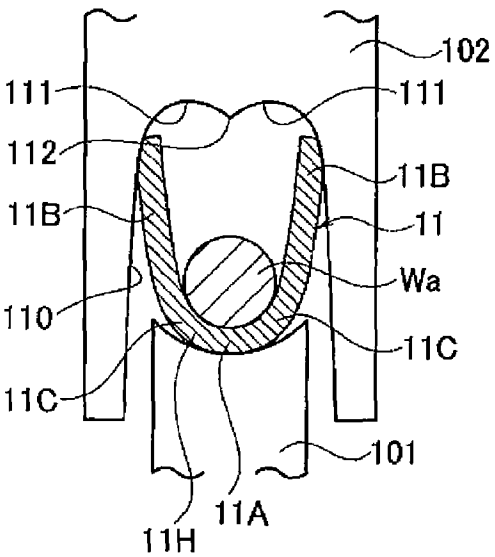
FIGS. 2(*a*) to 2(*c*) are step explanatory diagrams in the case of pressing and bonding the press bond terminal to the conductor, and FIG. 2(*a*) is a diagram of the conductor press bond part showing a state in which conductor crimp pieces start to be laid inward, and FIG. 2(*b*) is a diagram showing a state in which the conductor crimp pieces start to be rounded inward, and FIG. 2(*c*) is a diagram showing a state in which the conductor crimp pieces are rounded so as to be folded back to the conductor side.
Figure 2B:
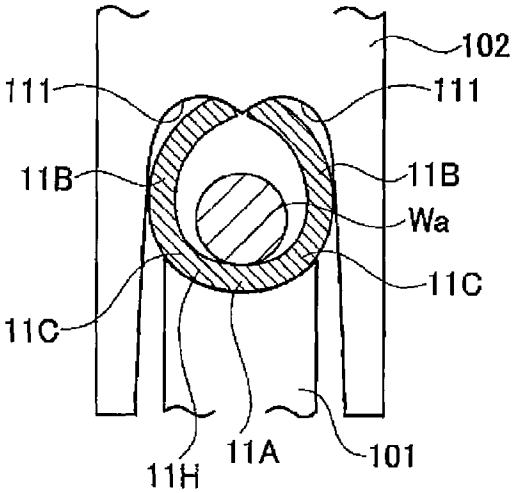
Figure 2C:
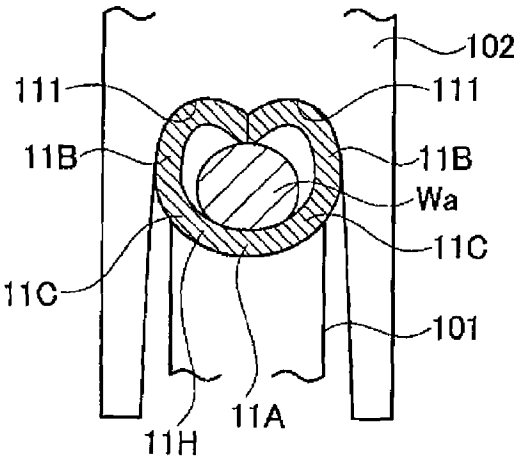
Figure 3:
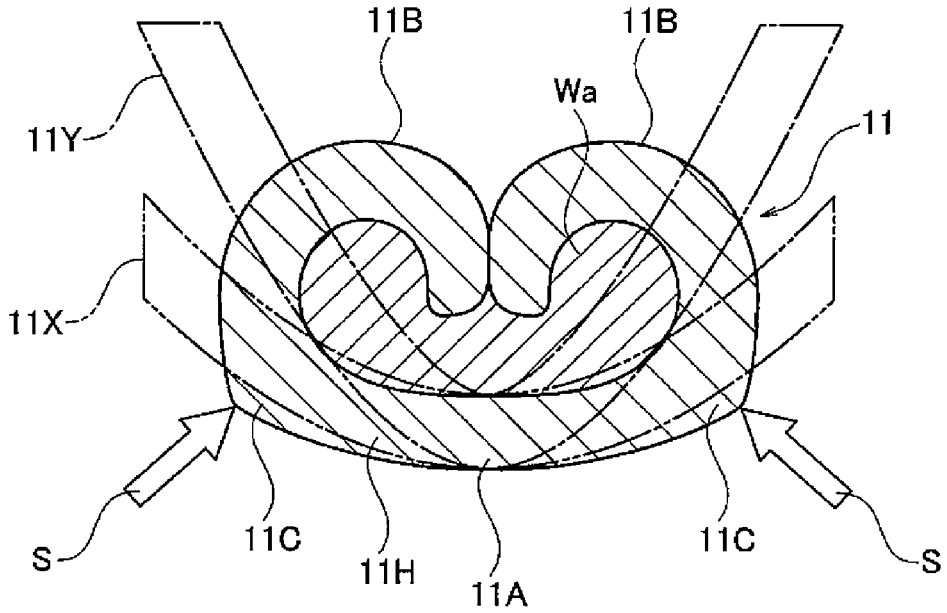
FIG. 3 is a sectional view showing a state of finally pressing and bonding the press bond terminal to the conductor, and a chain line in the drawing shows the original shape of the conductor press bond part of the press bond terminal of the embodiment, and a two-dot chain line in the drawing shows the original shape of a conductor press bond part of a conventional general press bond terminal.
Figure 4:
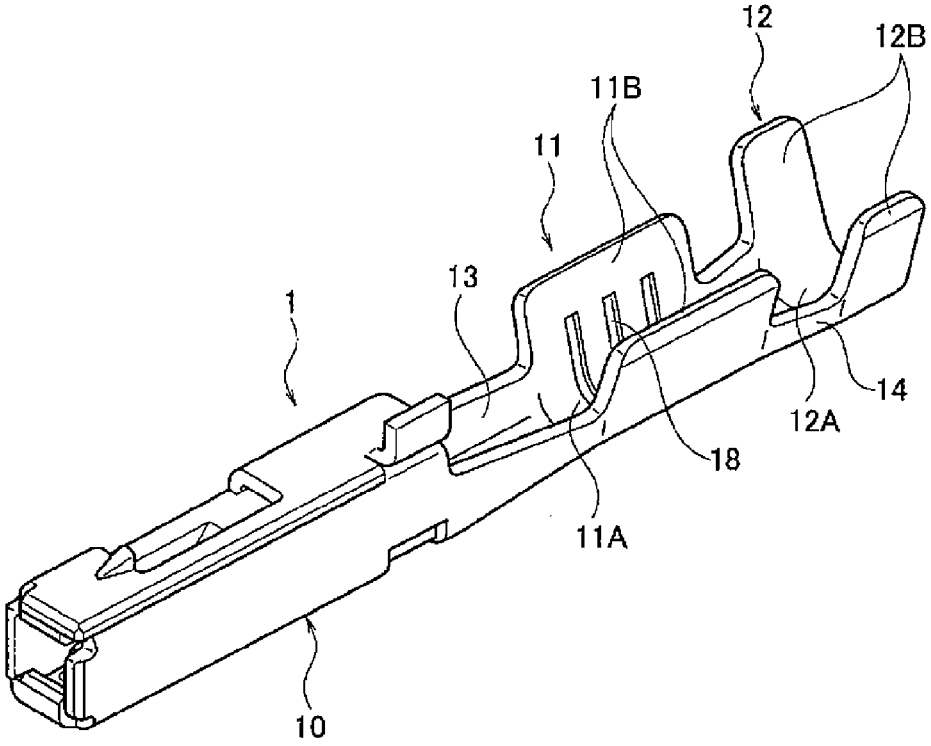
FIG. 4 is a perspective view showing a configuration of a conventional press bond terminal.
Figure 5:
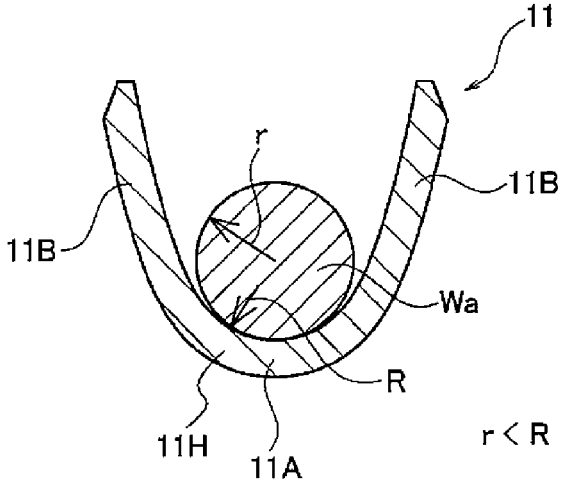
FIG. 5 is a diagram showing a relation between the conductor press bond part of the conventional press bond terminal and a conductor of an electric wire.

FIGS. 1(*a*) and 1(*b*) are main configuration diagrams of a press bond terminal of an embodiment, and FIG. 1(*a*) is a sectional view showing a relation between a conductor press bond part of the press bond terminal and a conductor of an electric wire, and FIG. 1(*b*) is a diagram showing an initial stage of an operation in the case of pressing and bonding the conductor press bond part to the conductor, and FIGS. 2(*a*) to 2(*c*) are step explanatory diagrams in the case of pressing and bonding the same press bond terminal to the conductor, and FIG. 2(*a*) is a diagram of the conductor press bond part showing a state in which conductor crimp pieces start to be laid inward, and FIG. 2(*b*) is a diagram showing a state in which the conductor crimp pieces start to be rounded inward, and FIG. 2(*c*) is a diagram showing a state in which the conductor crimp pieces are rounded so as to be folded back to the conductor side. FIG. 3 is a sectional view showing a state of finally pressing and bonding the same press bond terminal to the conductor, and a chain line in the drawing exaggeratedly shows the original shape of the conductor press bond part of the press bond terminal of the embodiment, and a two-dot chain line in the drawing exaggeratedly shows the original shape of a conductor press bond part of a conventional general press bond terminal.

In the press bond terminal of the present embodiment, a conductor press bond part 11 connected by being pressed and bonded to the distal end of a conductor Wa of an electric wire is formed in substantially a U-shaped cross section opened upward by a base plate 11A and a pair of conductor crimp pieces 11B, 11B extended upward from both right and left lateral edges of the base plate 11A as shown in FIG. 1(*a*). Then, the range from the base plate 11A to the root of a pair of conductor crimp pieces 11B, 11B is formed as a curved wall 11H with substantially a circular arc shape and when a radius of curvature of an inner surface of the curved wall 11H is R and a radius of the conductor Wa of the electric wire is r, the curved wall 11H is characterized by being set so as to satisfy R<r.

In the case of pressing and bonding this press bond terminal to the electric wire, as shown in FIG. 1(*b*), the conductor press bond part 11 of the press bond terminal is arranged between a lower mold (an anvil) 101 and an upper mold (a crimper) 102 of a press bond device and also, the distal end of the conductor Wa of the electric wire is inserted between a pair of conductor crimp pieces 11B, 11B. In this case, the radius R of curvature of the inner surface of the curved wall 11H (that is, the range from the base plate 11A of the conductor press bond part 11 to the root of a pair of conductor crimp pieces 11B, 11B) is set smaller than the radius r of the conductor of the electric wire, so that the conductor Wa abuts on inner surfaces of the conductor crimp pieces 11B in the middle of a height direction of the conductor crimp pieces 11B and stops, and is held in a state of no contact with the base plate 11A of the conductor press bond part 11. In other words, the conductor is held in a state in which there is a gap H between the conductor Wa and an inner surface of the base plate 11A.

When press bond processing is performed by downward moving the upper mold 102 of the press bond device relatively with respect to the lower mold 101 from this state, as shown in FIG. 2(*a*), the distal ends of a pair of conductor crimp pieces 11B, 11B are gradually laid inward by making contact with a guide inclined surface 110 of the upper mold 102 and by further downward moving the upper mold 102 relatively with respect to the lower mold 101, as shown in FIGS. 2(*b*) and 2(*c*), the distal ends of a pair of conductor crimp pieces 11B, 11B abut on curved surfaces 111 ranging from the guide inclined surface 110 of the upper mold to a chevron-shaped part 112 of the center and thereby are guided inward and are rounded so as to be folded back to the side of the conductor Wa and, finally as shown in FIG. 3, the distal ends of both conductor crimp pieces 11B, 11B are mutually bitten into the conductor Wa while being rubbed together and thereby, both conductor crimp pieces 11B, 11B are crimped so as to wrap the conductor Wa with the base plate 11A.

In the case of this series of operations, the conductor Wa of the electric wire is pushed on the base plate 11A of the conductor press bond part 11 and accordingly, the curved wall 11H (the range from the base plate 11A to the root of the conductor crimp pieces 11B) is outward pushed out by being subjected to a pressure from the conductor Wa and a pressure from the conductor crimp pieces 11B. Then, in a state of outward pushing out the curved wall 11H, the distal ends of the conductor crimp pieces 11B are finally crimped so as to be bitten into the conductor Wa to complete the press bonding.

Therefore, in a final press bond state shown in FIG. 3, a great spring-back force by which the curved wall 11H returns to the original shape (that is, shape shown by 11Y) with small curvature is generated in the curved wall 11H. Particularly, the spring-back forces S generated at shoulder parts 11C which are the boundaries between the base plate 11A and the root of the conductor crimp pieces 11B become greater than spring-back forces in the case of returning to the original shape (that is, shape shown by 11X) with large curvature like a conventional press bond terminal, and act as a contact pressure of making close contact with the conductor Wa wrapped inward, with the result that adhesion between the conductor Wa and the terminal increases and contact resistance is low to become stable.

As described above, in the case of pressing and bonding the press bond terminal of the embodiment to the conductor Wa of the electric wire using the upper mold 102 and the lower mold 101, the spring-back force can effectively be generated with respect to the terminal, so that the terminal can be connected to the electric wire by stable contact resistance.

The present application is based on Japanese patent application (patent application No. 2009-258534) filed on Nov. 12, 2009, and the contents of the patent application are hereby incorporated by reference.

DESCRIPTION OF REFERENCE NUMERALS AND SIGNS

11 CONDUCTOR PRESS BOND PART
11A BASE PLATE
11B CONDUCTOR CRIMP PIECE
11H CURVED WALL
101 LOWER MOLD
102 UPPER MOLD
110 GUIDE INCLINED SURFACE
111 CURVED SURFACE
112 CHEVRON-SHAPED PART
Wa CONDUCTOR OF ELECTRIC WIRE

The invention claimed is:

1. A press bond terminal having a conductor press bond part connected by being pressed and bonded to a distal end of a conductor of an electric wire, the conductor press bond part being formed in substantially a U-shaped cross section opened upward by a base plate and a pair of conductor crimp pieces extended upward from both right and left lateral edges of the base plate, the press bond terminal being electrically connected to the electric wire by inserting the conductor of the electric wire between the pair of conductor crimp pieces in the case of being pressed and bonded to the electric wire and inward rounding the pair of conductor crimp pieces to crimp the conductor crimp pieces so as to wrap the conductor with the base plate by a press bond operation of a lower mold and an upper mold of a press bond device in its insertion state, wherein a range from the base plate to the root of the pair of conductor crimp pieces is formed as a curved wall with substantially a continuously circular arc shape and when a radius of curvature of an inner surface of the curved wall is R and a radius of the conductor of the electric wire is r, the curved wall is set so as to satisfy R<r, and wherein in a final press bond state the conductor press bond part is formed with an elongated cross section.

2. A method for pressing and bonding a press bond terminal having a conductor press bond part connected by being pressed and bonded to a distal end of a conductor of an electric wire, the conductor press bond part being formed in substantially a U-shaped cross section opened upward by a base plate and a pair of conductor crimp pieces extended upward from both right and left lateral edges of the base plate, the press bond terminal being electrically connected to the electric wire by inserting the conductor of the electric wire between the pair of conductor crimp pieces in the case of being pressed and bonded to the electric wire and inward rounding the pair of conductor crimp pieces to crimp the conductor crimp pieces so as to wrap the conductor with the base plate by a press bond operation of a lower mold and an upper mold of a press bond device in its insertion state, wherein a range from the base plate to the root of the pair of conductor crimp pieces is formed as a curved wall with substantially a continuously circular arc shape and when a radius of curvature of an inner surface of the curved wall is R and a radius of the conductor of the electric wire initially is r, the curved wall is set so as to satisfy $R<r$;

wherein the press bond terminal is arranged between an upper mold and a lower mold of a press bond device and also a distal end of a conductor of the electric wire is inserted between the pair of conductor crimp pieces, the conductor initially placed abutting an inner surface of the pair of conductor crimp pieces so that there is a gap between the conductor and an inner surface of the base plate, and the upper mold is downward moved relatively with respect to the lower mold in its insertion state and thereby the pair of conductor crimp pieces is laid inward by action of a guide inclined surface of the upper mold and further the upper mold is downward moved relatively with respect to the lower mold and thereby the pair of conductor crimp pieces is rounded inward so as to be folded back to the conductor side by action of a curved surface ranging from the guide inclined surface of the upper mold to a chevron-shaped part of the center and finally distal ends of the conductor crimp pieces are mutually bitten into the conductor while being rubbed together and thereby both conductor crimp pieces are crimped so as to wrap the conductor with the base plate.

* * * * *